US005743035A

United States Patent [19]

Bradley et al.

[11] Patent Number: 5,743,035

[45] Date of Patent: Apr. 28, 1998

[54] MACHINE PRODUCIBLE THREE DIMENSIONAL GREETING CARD

[75] Inventors: Sterling E. Lani Bradley, Olmsted; Jayne M. Gause, Cleveland; Andrew Onachilla, Brooklyn, all of Ohio

[73] Assignee: American Greetings Corporation, Cleveland, Ohio

[21] Appl. No.: 532,312

[22] Filed: Sep. 22, 1995

[51] Int. Cl.[6] ..... G09F 1/00

[52] U.S. Cl. ..... 40/124.14; 40/539; 283/117

[58] Field of Search ..... 40/124.1, 539, 40/124.09, 124.13, 124.14; 446/80, 147, 488; 283/117

[56] References Cited

U.S. PATENT DOCUMENTS

| | | | |
|---|---|---|---|
| Re. 22,109 | 6/1942 | Hayes . | |
| 1,841,041 | 1/1932 | Lowenstein . | |
| 2,580,241 | 12/1951 | Podmore | 446/488 |
| 2,984,920 | 5/1961 | Acosta et al. . | |
| 3,174,244 | 3/1965 | Walton . | |
| 4,763,427 | 8/1988 | Schrager | 40/539 X |
| 4,765,006 | 8/1988 | Jackson et al. | 446/488 X |
| 4,885,859 | 12/1989 | Gasser . | |
| 4,949,482 | 8/1990 | Price | 40/539 X |
| 5,010,669 | 4/1991 | Moran | 40/539 |
| 5,269,084 | 12/1993 | Best et al. . | |
| 5,317,823 | 6/1994 | Brunt, II . | |
| 5,418,020 | 5/1995 | Crane | 446/488 X |

FOREIGN PATENT DOCUMENTS

| | | | |
|---|---|---|---|
| 402119 | 11/1933 | United Kingdom | 40/539 |
| 8900877 | 2/1989 | WIPO | 446/147 |

*Primary Examiner*—Brian K. Green
*Attorney, Agent, or Firm*—Calfee, Halter & Griswold LLP

[57] ABSTRACT

A machine producible three dimensional greeting card formed from card stock automatically printed, die cut, gate folded and adhered to mechanically produce a card in a folded configuration which can be unfolded by an end user into three dimensions. In a preferred embodiment, the three dimensional greeting card includes four fold lines and five panels, with end panels adhered together, whereby the panels of the card in an unfolded configuration occupy four different planes. Areas of panels may be die cut to extend beyond fold lines into adjacent panels. Print images upon both sides of the panels may correspond to die cut patterns or profiles of peripheral and/or internal cuts. Corresponding front and back images may be printed on opposite sides of the card. The card is folded so that opposite end panels overlap and are adhered back to front whereby the card can be unfolded into a three dimensional configuration by the end user and stood upon edges of the panels for display.

12 Claims, 4 Drawing Sheets

MACHINE PRODUCIBLE THREE DIMENSIONAL GREETING CARD

FIELD OF THE INVENTION

The present invention pertains generally to greeting cards and automated methods of making greeting cards and, in particular, to three dimensional greeting cards having multiple foldable panels.

BACKGROUND OF THE INVENTION

Greeting cards having multiple panels are desirable for the large amount of area provided for graphic and textual printing and the entertainment value of multiple panels or pages for three-dimensional presentation of a greeting message. Cards which may be folded out or assembled into three dimensional configurations typically require detachment of one or more panels and/or sub-panels or insertion of locking tabs into slits in adjacent panels. Such cards are relatively difficult and expensive to mass produce for the reasons that multiple fold lines and cuts must be made in order to form the panels, and the card must be pre-folded by manual construction and assembly and manual gluing so that it can be readily opened by the customer.

SUMMARY OF THE INVENTION

The present invention provides a machine producible multiple panel three dimensional greeting card and method of manufacture. The greeting card of the invention is formed from a single folded sheet of card stock peripherally and internally die cut, glued and folded by machine to automatically produce a card which can be unfolded into three dimensions by the recipient.

In accordance with one aspect of the invention, a multiple panel three dimensional greeting card is automatically formed from a single sheet of card stock which may be printed upon both sides and cut along peripheral edges and interior portions to create unique panel profiles. The die cut card stock is folded and/or scored by automated machinery along multiple generally parallel fold lines which define adjoining edges of multiple panels. Opposite end panels of the card are adhered back to front as the panels are folded together against areas where adhesive is automatically applied. The card is thus configurable into a three dimensional structure having a rectangular or trapezium shaped base formed by edges of the panels.

In accordance with another aspect of the invention, a method of automatically producing three dimensional greeting cards includes the steps of printing a greeting card image on greeting card stock, cutting greeting cards from the greeting card stock by an automatic die cutting machine, applying glue to at least one area of the greeting card stock by an automated glue applying apparatus, folding the printed greeting card stock in an automated folding machine whereby the applied glue adheres at least two panels of the card in a folded configuration.

In accordance with another aspect of the invention, peripheral edge portions of the panels may be die cut to overlap fold lines and extend into an adjacent panel, whereby a peripheral edge of one panel projects across and through the plane of an adjacent panel when the card is unfolded.

In accordance with another aspect of the invention, the generally parallel fold lines may be relatively spaced to define panels of unequal length whereby the card in an unfolded configuration, with end panels adhered, has a trapezium base upon which to stand in an upright position.

In accordance with another aspect of the invention, images printed upon both sides of the card stock can be complementarily corresponding whereby a frontal image of an object is printed directly opposite a posterior image of the same object, and both images of the object are openly visible when the card is in an unfolded three dimensional configuration.

These and other aspects of the invention will be apparent from the following detailed description made with reference to the accompanying Figures.

DETAILED DESCRIPTION OF A PREFERRED EMBODIMENT

Figure 1:
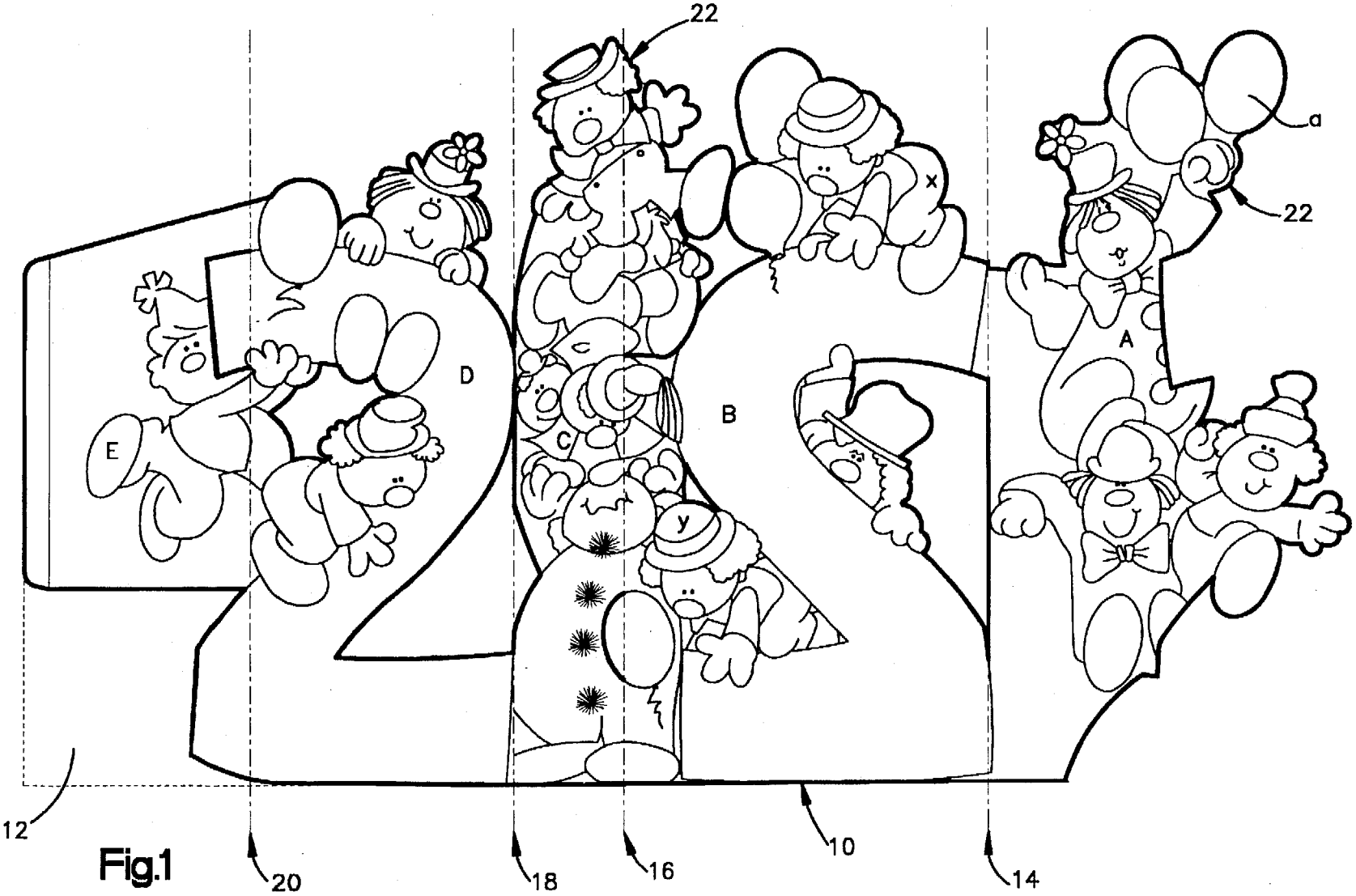
FIG. 1 is a plan view of a greeting card of the present invention in an unfolded configuration.

FIG. 1 illustrates a card 10 die cut from a piece of card stock 12 which bears printed graphics and/or textual images on both sides of the card stock. The card may be printed upon both sides of the stock in an uncut and unfolded state by automated printing machinery. The card stock is die cut to form peripheral edges and/or internal cut-outs which may correspond to positions of printed images and text and to the relative placement of the fold and score lines. For example, the profile of an image of a character printed on the card stock can serve as a portion of the die cut pattern, whether along the periphery of the card such as character x or internally such as character y. Score lines may also be automatically formed by partial cutting or indentation of the card stock, for example in the die cutting operation, along a line or lines to bias the card to fold along the line when opened. The die cut card stock is then loaded into an automatic card folding machine well known in the art such as those sold by International, Inc. and Longford Ltd. The cards are oriented to be carried through the machine in a direction parallel to the fold lines to be formed. Fold lines are automatically formed in the cards by selective placement of the folding machine swords adjacent folding belts which pick up and turn a portion or panel of the card over the sword to form a fold. For example, fold lines 14, 16, 18 and 20 may be formed in this manner and relatively spaced to define adjoining panels A–E, preferably of differing widths, so that the bottom edges of the panels form a trapezium base on which to stand the card in an unfolded configuration. The four generally parallel fold lines allow the card to be gate folded. With end panels A and E adhered together, the card may be unfolded or opened into a three dimensional configuration. As used herein, the term "three dimensional" means a card which has when unfolded height, width and depth (greater than the thickness of the card stock) by having more than two panels, at least two fold lines, and at least two panels adhered together. In an unfolded configuration, the panels of the three dimensional greeting card of the invention occupy at least four different planes. By having five panels with the end panels adhered together, the three dimensional card of the invention can be folded flat into a single plane.

Figure 2:
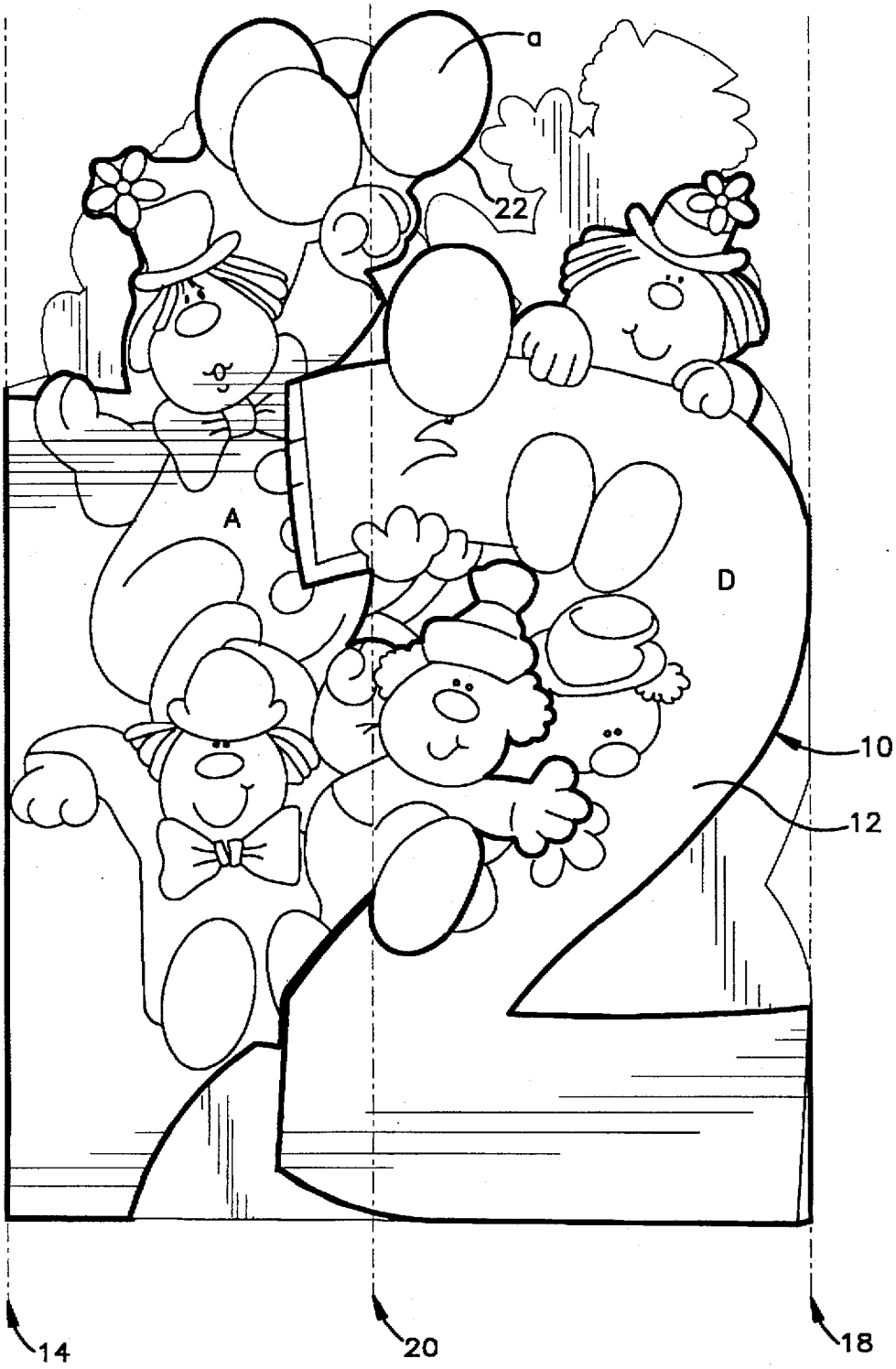
FIG. 2 is a plan view of a frontal portion of the greeting card of the present invention in a folded configuration.
Figure 3:
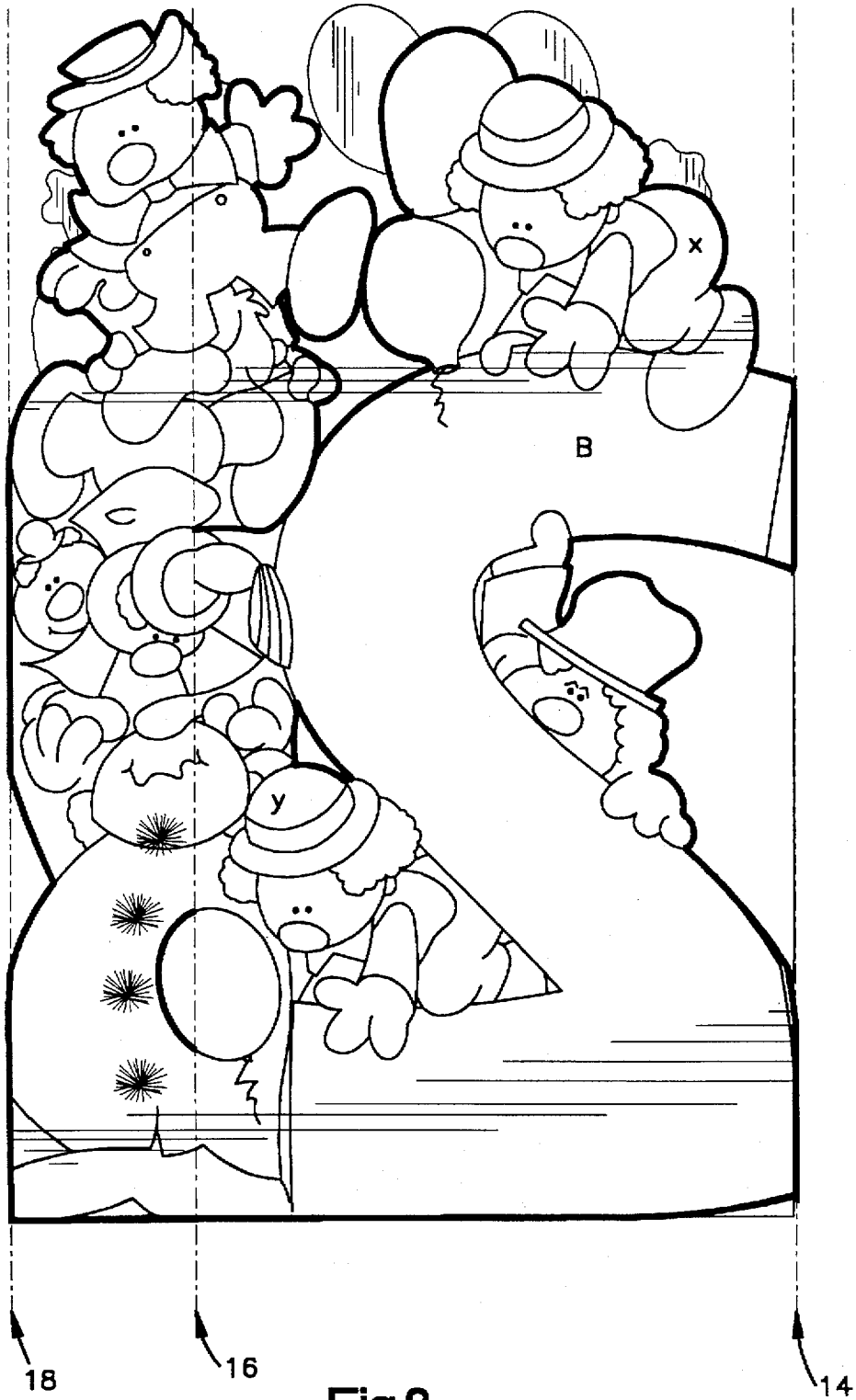
FIG. 3 is a plan view of a rear panel portion of the greeting card of the present invention in a folded configuration.

The automated folding machine may also be suitably equipped to automatically apply glue or other adhesive to certain areas of the card as it is conveyed through the machine just prior to final folding and pressing. Thus, as a section of the card is folded on to an area of applied adhesive the respective panels are adhered together, either permanently or detachably. In this example, adhesive may be automatically applied to the front of panel E. As the card progresses through the folding machine in the direction indicated, and fold lines 14, 16 18 and 20 are successively formed, the back of panel A is brought into contact with the front of panel E to adhere the two together. The card is then pressed in a folded/adhered state ready for packaging. FIGS. 2 and 3 illustrate the card in a flat, folded configuration as it is when released by the automatic production machinery. In this state, the card may be automatically or manually wrapped and/or stacked or otherwise packaged for shipment.

Figure 4:
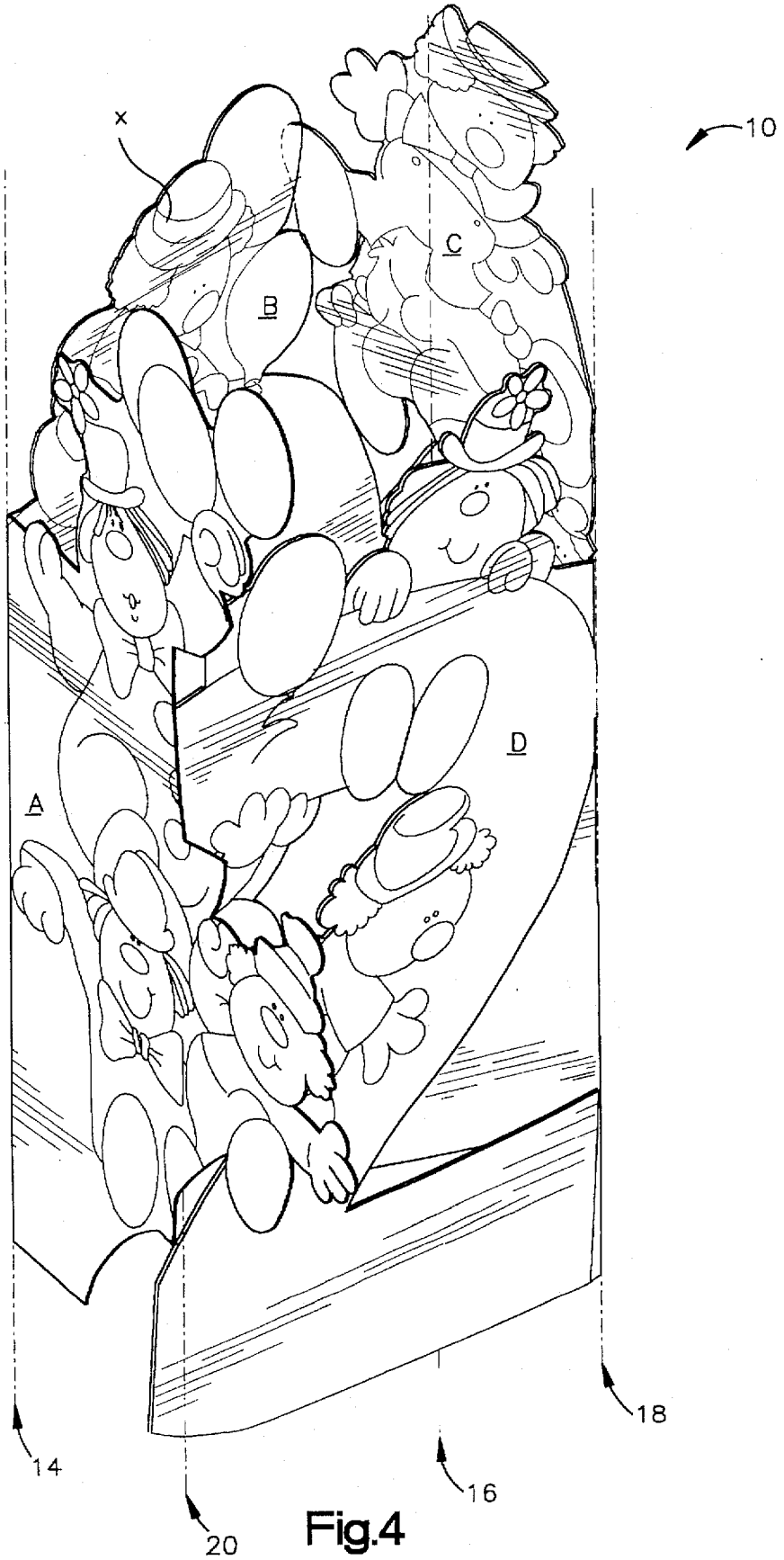
FIG. 4 is a perspective view of the greeting card of the present invention in an unfolded three dimensional configuration.

As shown in FIGS. 2–4, peripheral edges of some panels, such as peripheral edge 22 of panel A, may be cut to transcend a fold line (for example, the portion of image a which is intersected by fold line 20 but not folded) so that when the panels are adhered and folded along the fold lines, that portion of panel A (image a) does not fold into the plane of adjacent panel D. This further increases the visibility of the back side of image a to which may be applied graphics which correspond to a front image applied to the opposite (front) side of image a.

When folded out in the configuration illustrated in FIG. 4, the card thus assumes a three dimensional (and in this embodiment, trapezoidal) shape wherein the panels of the card occupy four different planes and the card may be stood upright upon the bottom edges of the panels for display. Both sides of each of the panels, including the corresponding front and back image priming, are visible in this configuration.

The three dimensional card of the invention is thus uniquely adapted and especially suited for entirely automated production by the following steps, the order of which may be altered and still be within the scope of the method of the invention. Greeting card images are printed upon one or both sides of card stock. Individual cards are die cut from the printed card stock in patterns which may correspond to the printed images. The die cuts define peripheral edges of the cards and may include internal cut outs in one or more panels of the cards. Score lines may be formed in the cards in connection with the die cutting operation, wherein a cutting die is configured to also form one or more score lines. The cards are then placed in an automatic folding and gluing machine which forms at least two generally parallel fold lines in the manner described, thereby defining at least three and preferably four or five or more panels to the cards, and applies adhesive to at least one panel so that as another panel is folded on to the adhesive the two panels are adhered together. The cards are then pressed in a folded and adhered configuration.

The invention thus novelly provides a foldable multiple panel three dimensional greeting card automatically constructed of a single piece of card stock printed, die cut, folded and adhered together by automated machinery so that the card is unfolded only by the purchaser or end user for display in a three dimensional upright manner.

Although the invention has been described with respect to a particular embodiment, it will be appreciated by those of skill in the art that the basic principles of the invention are applicable to an infinite variety of greeting cards having peripheral and internal configurations and graphics different from the example yet within the scope of the claims and/or equivalent to the example described.

What is claimed is:

1. A three dimensional foldable greeting card comprising:

a single piece of card stock having multiple panels including end panels and intermediate panels adjoined at generally straight and parallel fold lines wherein the fold lines are spaced apart relative distances so that the panels of the card form a three dimensional structure, each of the panels having peripheral edges cut to define generally curvilinear profiles, a portion of the peripheral edge on each panel cut to extend past a fold line through the plane of an adjacent panel and not folded along the fold line crossed, the panels oriented to be displayed by support upon generally straight bottom edges of the panels, end panels of the greeting card intersecting, graphics applied to both sides of at least one panel, whereby the card may be stood upon the generally straight bottom edges when the card is in a three dimensional configuration.

2. The greeting card of claim 1 wherein an interior area of a panel is cut out.

3. The greeting card of claim 1 wherein the peripheral edges of the panels are cut in a pattern which corresponds to printing upon the panels.

4. The greeting card of claim 1 wherein the graphics applied to the card comprise a front image and a corresponding rear image applied to a side of the card directly opposite the front image.

5. The greeting card of claim 1 comprising at least three fold lines which form a gate fold card configuration.

6. The greeting card of claim 1 comprising at least four generally parallel fold lines.

7. The greeting card of claim 1 wherein the fold lines are spaced apart unequal distances.

8. The greeting card of claim 1 in a folded configuration wherein all panels of the card are in a single plane.

9. The greeting card of claim 1 in an unfolded configuration wherein the panels of the card occupy at least four different planes.

10. A machine producible three dimensional greeting card foldable into a generally flat configuration wherein all panels of the card occupy a single plane and unfoldable into a three dimensional configuration wherein panels of the card occupy at least four different planes, the greeting card comprising:

a single piece of card stock having at least four generally parallel fold lines, at least three panels and two end panels adjoined by the fold lines, images printed on both sides of at least one panel, and generally curvilinear peripheral edges on each panel, a portion of a peripheral edge on each panel cut to extend through the plane of an adjacent panel wherein an area of a panel which extends through the plane of an adjacent panel crosses over a fold line and is not folded into the plane of the adjacent panel when the greeting card is in a three dimensional configuration.

11. The greeting card of claim 10 wherein the end panels are adhered together.

12. The greeting card of claim 10 wherein the end panels are intersecting.

* * * * *